US006502253B1

(12) United States Patent
Olney

(10) Patent No.: US 6,502,253 B1
(45) Date of Patent: Jan. 7, 2003

(54) PILLOW STRUCTURE FOR ATTACHMENT TO THE SHELL OF A HOT TUB

(75) Inventor: Robert Kent Olney, Etiwanda, CA (US)

(73) Assignee: Jacuzzi, Inc., Walnut Creek, CA (US)

( * ) Notice: Subject to any disclaimer, the term of this patent is extended or adjusted under 35 U.S.C. 154(b) by 0 days.

(21) Appl. No.: 10/042,800

(22) Filed: Jan. 9, 2002

(51) Int. Cl.[7] ..... A47K 3/00; A47K 3/12
(52) U.S. Cl. ..... 4/575.1; 4/541.1
(58) Field of Search ..... 4/575.1, 541.1; 248/118; 297/391, 394

(56) References Cited

U.S. PATENT DOCUMENTS 3,123,403 A * 3/1964 Hood ..... 248/118 X
3,387,881 A * 6/1968 Stepanek et al. ..... 248/118 X
5,333,324 A * 8/1994 Pinciaro ..... 4/541.1 X
5,928,171 A * 7/1999 Larsen ..... 4/575.1 X
6,149,231 A * 11/2000 Wustholz ..... 297/391 X
6,256,805 B1 * 7/2001 Ludlow et al. ..... 4/541.1

* cited by examiner

*Primary Examiner*—Charles E. Phillips
(74) *Attorney, Agent, or Firm*—Thomas R. Lampe

(57) ABSTRACT

A pillow structure is releasably connected to a hot tub shell. The pillow structure includes a border pillow having an opening providing access to the border pillow interior and an insert pillow releasably attached to the border pillow. When in place, the insert pillow covers the opening for preventing manual access to and viewing of connector structure utilized to attach the border pillow to the shell.

8 Claims, 3 Drawing Sheets

PILLOW STRUCTURE FOR ATTACHMENT TO THE SHELL OF A HOT TUB

TECHNICAL FIELD

This invention relates to pillow structure utilized with spas, whirlpool baths and other types of hot tubs.

BACKGROUND OF THE INVENTION

It is well known to provide pillows for spas and other forms of hot tubs. Typically, such pillows are of unitary construction and attached to a shell as a unit by some suitable form of connector. For example, adhesive and adhesive tape can be used to attach the pillow directly to the inner shell surface. Dislodgment of prior art pillows of this nature is a relatively common occurrence. It also is known to attach pillows to shells by mechanical connectors including bolts or screws extending through the shell. Installation and removal of pillows utilizing this attachment approach presents difficulties, often requiring access to connectors from locations outside of the shell, something which is not always readily feasible. Furthermore, prior art pillows are often installed in direct engagement with the shell wall and deterioration of the pillow due to the action of water and chemicals can be a problem. Formation of mold and mildew is also a problem, at least partially due to trapped water.

DISCLOSURE OF INVENTION

The present invention encompasses pillow structure which cooperates with the shell of a hot tub in a unique manner. The term hot tub, as used herein, includes all types of spas, baths and the like. With the arrangement of this invention, installation and removal of the pillow structure are readily accomplished. Furthermore, due to the character of the pillow structure, deterioration of the pillow is deterred and the useful life of the pillow substantially lengthened.

According to the combination of the present invention, pillow structure is employed on the shell of a hot tub.

The pillow structure comprises a border pillow having a border pillow front and a border pillow back. The border pillow defines an interior and an opening in the border pillow front communicating with the interior.

Connector means releasably connects the border pillow to the shell. A portion of the connector means is exposed to the interior of the border pillow.

An insert pillow is releasably attached to the border pillow. The insert pillow, when attached, covers the opening for preventing manual access to the connector means through the opening and for blocking the connector means portion from view.

Other features, advantages and objects of the present invention will become apparent with reference to the following description and accompanying drawings.

MODES FOR CARRYING OUT THE INVENTION

Figure 1:
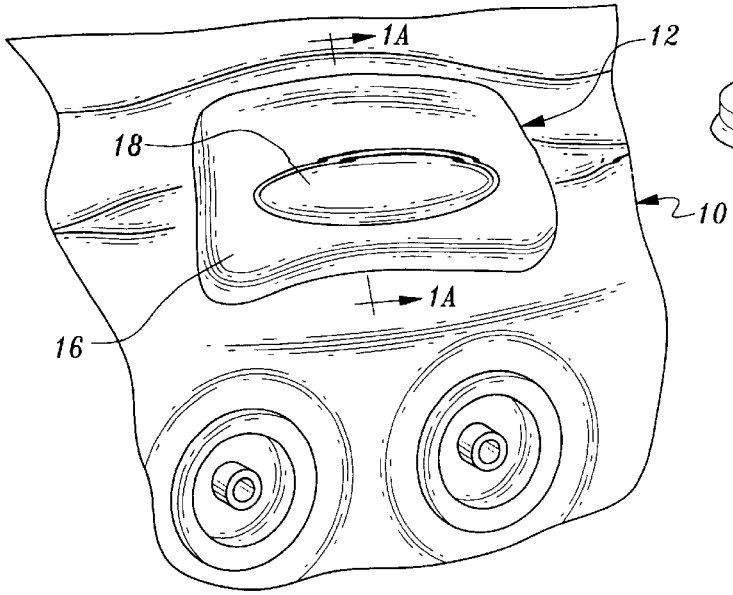
FIG. 1 discloses a portion of a spa including the spa shell having pillow structure constructed in accordance with the teachings of the present invention attached thereto.
Figure 2:
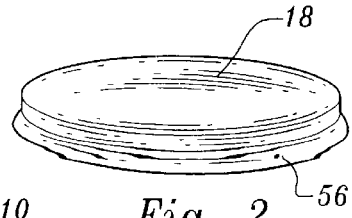
FIG. 2 is a perspective view of the insert pillow of the pillow structure of FIG. 1.

Referring now to FIGS. 1–6, a preferred embodiment of the invention is illustrated. In FIG. 1 and certain other figures, a portion of a spa shell 10 is shown. The portion has releasably attached thereto pillow structure 12 constructed in accordance with the teachings of the present invention. The pillow structure 12 generally conforms in shape to a cavity 14 (see FIG. 4) molded into the spa shell.

Pillow structure 12 includes a border pillow 16 and an insert pillow 18 releasably attached thereto.

The border pillow 16 is releasably connected to the shell by connector structure of a type which will now be described.

In the arrangement illustrated, two openings 20 (only one of which is illustrated—see FIG. 5) are formed in shell 10 at the location of cavity 14. A bushing 30 passes through each of the openings 20. The bushing 30 has external threads 32 and internal threads 34. The bushing also includes an enlarged bushing head 36 having flat peripheral surfaces for engagement by a wrench or the like.

A wing nut 40 is positioned externally of the shell 10 and is threadedly engaged with the external threads 32 of the bushing. The bushing head 36 is positioned interiorly of the shell.

A bolt 42 is threadedly engaged with the internal threads of the bushing. The bolt extends through an aperture 44 formed in the border pillow. Since two sets of connectors are utilized in the arrangement under discussion, it will be appreciated that a second aperture 44 (not shown) to accommodate the bolt of the second connector is formed in the spa shell.

The bolt 42 has a bolt head 46 which engages the border pillow 16. An O-ring seal 50 is located between the spa shell and the bushing head 36.

It will be seen from the above that various thicknesses of spa shells and border pillows can be accommodated and attached together by the connector components.

In the initial assembly process, the bushing 30 is passed through opening 20 of the spa shell with the O-ring 50 disposed between the shell and the bushing head 36. Next, the wing nut 40 is applied and tightened into position at the back or exterior side of the shell. O-ring 50 prevents the passage of water through opening 20.

Next, the border pillow 16 is positioned with aperture 44 thereof in alignment with the bushing. Bolt 42 is then screwed into internal threads 34 to cause the border pillow to bear against bushing head 36. It is to be noted that the border pillow when so installed is spaced a distance from the spa shell at the location of the connectors so that water and/or chemicals which could have possible deleterious effects are not trapped therebetween.

Figure 3:
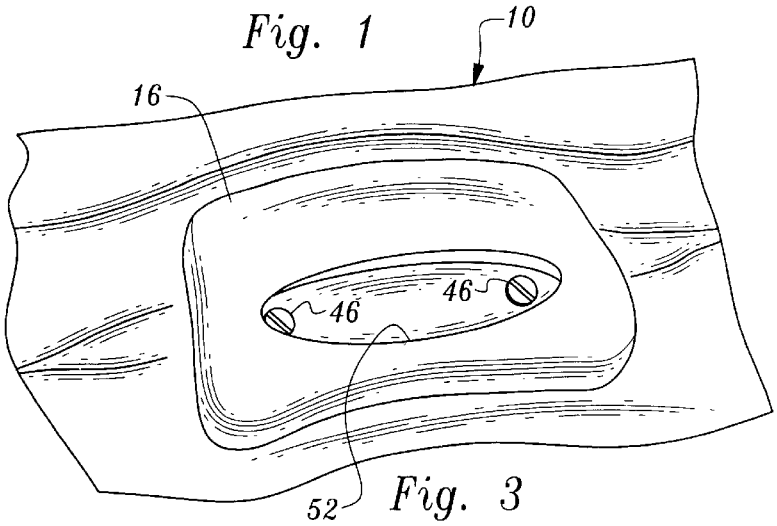
FIG. 3 shows the insert pillow removed from the border pillow of the pillow structure to expose the interior of the border pillow and connector portions.
Figure 4:
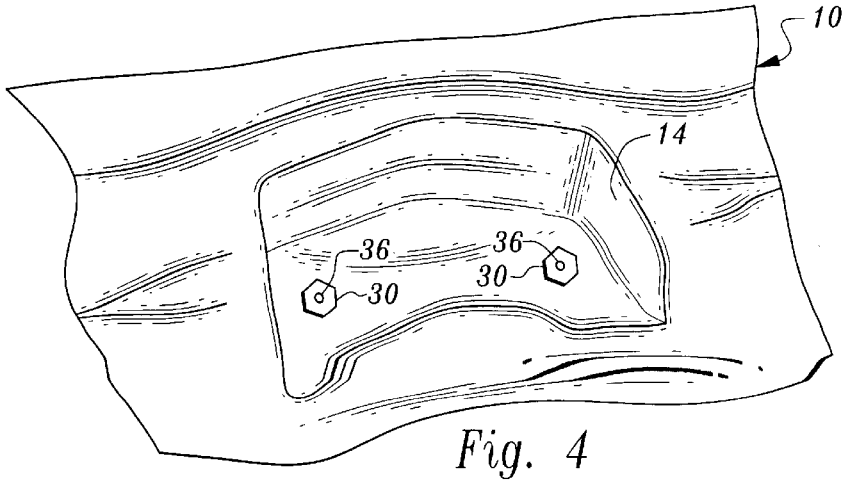
FIG. 4 is a perspective view of a portion of the spa shell prior to attachment of the pillow structure thereto.
Figure 5:
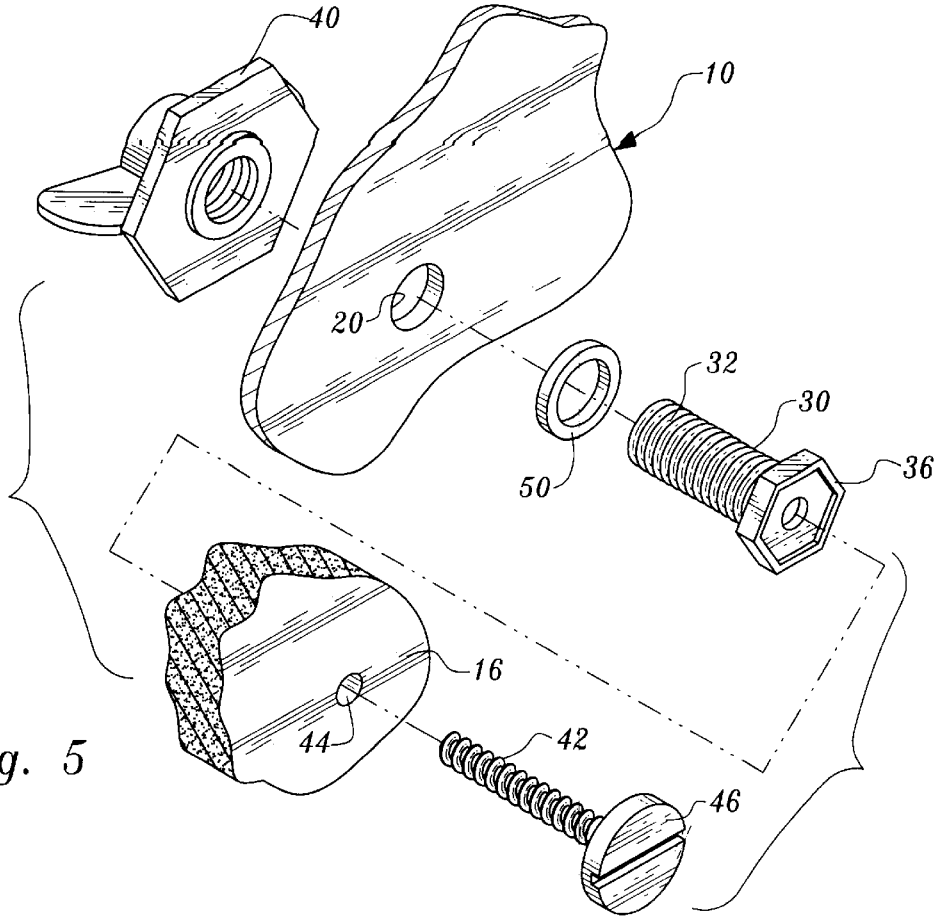
FIG. 5 is an exploded view illustrating components of connector structure utilized to attach the border pillow to the spa shell.
Figure 6:
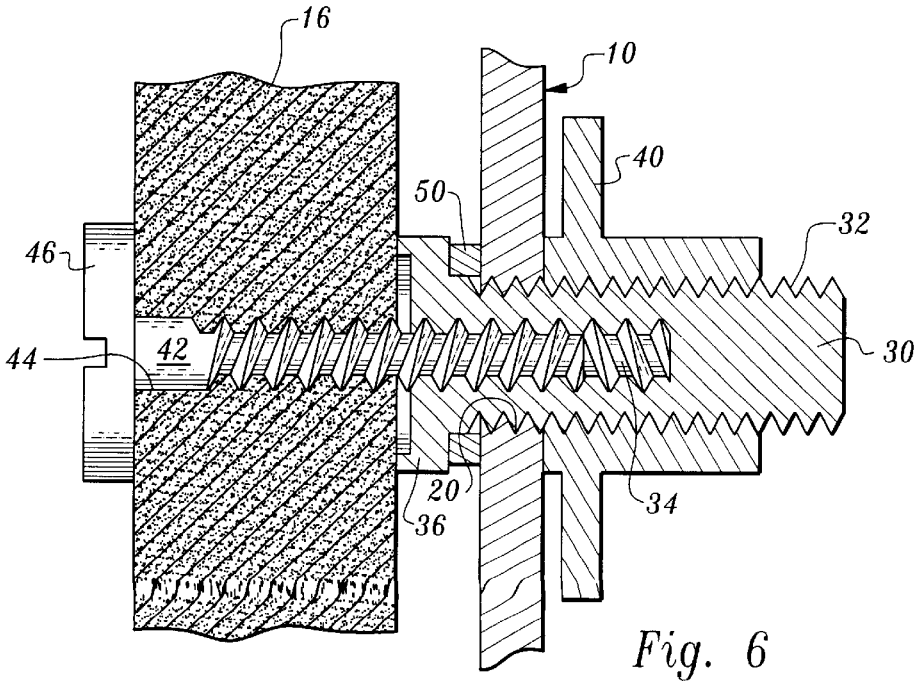
FIG. 6 is an enlarged, cross-sectional view illustrating the connector structure attaching the border pillow to the shell.

The border pillow 16 defines an interior which can be seen, for example, in FIG. 3. Furthermore, the border pillow defines a centrally disposed opening 52 which communicates with the interior. In the arrangement of FIGS. 1–6, the opening 52 is oval-shaped. The border pillow is suitably formed of polyolefin or urethane.

Insert pillow 18 is releasably attached to the border pillow and when in place, the insert pillow covers the opening 52 to prevent manual access to the connector structure through the opening. In addition, the insert pillow blocks bolt heads 46 from view.

Figure 1A:
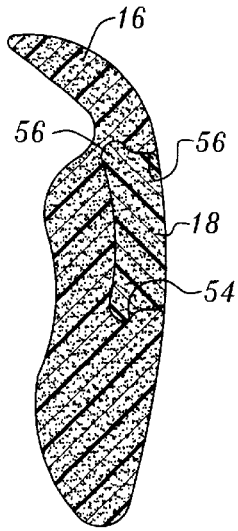
FIG. 1A is a greatly enlarged cross-sectional view taken along the line 1A—1A in FIG. 1.

In the arrangement shown, frictional engagement between the border pillow and the insert pillow is employed to releasably attach the insert pillow in place. As may best be seen with reference to FIG. 1A, the border pillow defines an indent adjacent to the opening 52 which is in the form of a continuous peripheral channel 54. On the other hand, the insert pillow includes an outer peripheral surface having a detent in the form of a continuous rib 56.

The insert pillow preferably is molded of a plastic material such as polyolefin or urethane and is softer and more resilient than the border pillow. The materials used in the construction of the border pillow and the insert pillow are preferably non-hydroscopic and are not conducive to the formation of mold or mildew.

The insert pillow may readily be snapped into place on the border pillow or removed therefrom due to the flexible, resilient physical characteristic of the material used to construct the insert pillow. The border pillow exerts compressive forces on the insert pillow adjacent to channel 54 to maintain an essentially water tight seal therebetween.

One wishing to remove the border pillow from the shell first removes the insert pillow from opening 52. This can be done simply by manually manipulating the insert pillow and pulling it out of position. After removal of the insert pillow has been accomplished, the bolts 42 are unbolted from the bushing by rotating bolt heads 46 through means of a screw driver or the like. Removal and replacement of the border pillow both are readily accomplished without having to obtain access to the outside of the spa shell. And, as stated above, different thicknesses of border pillows can be accommodated through use of the connector structure.

Figure 7:
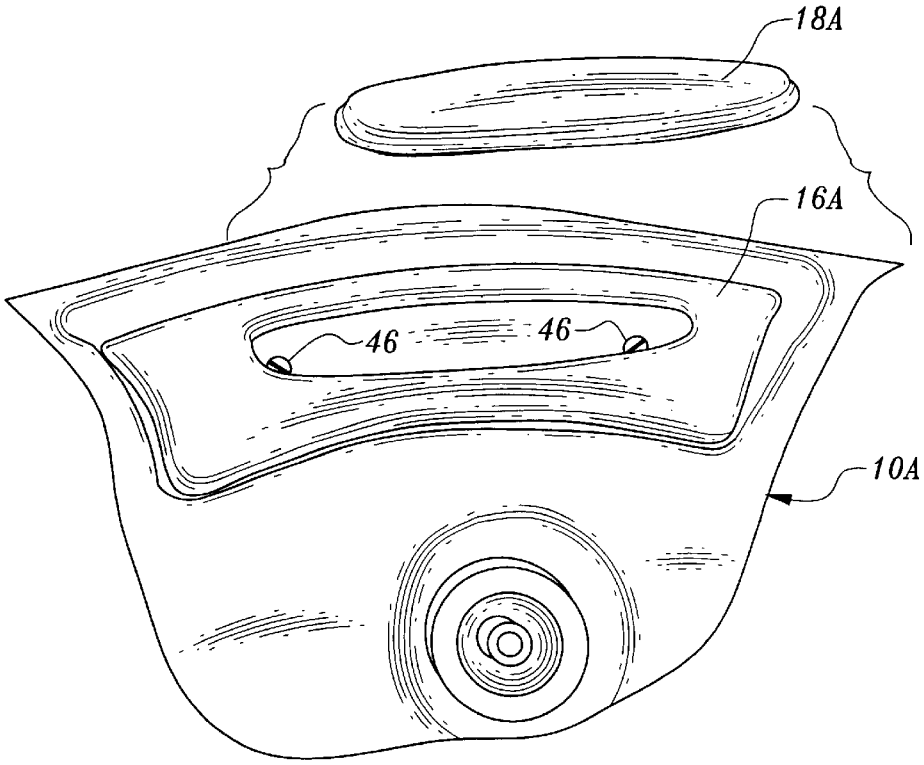
FIG. 7 is a perspective view of another embodiment of pillow structure, the insert pillow of such pillow structure being shown prior to releasable attachment thereof to the border pillow.
Figure 8:
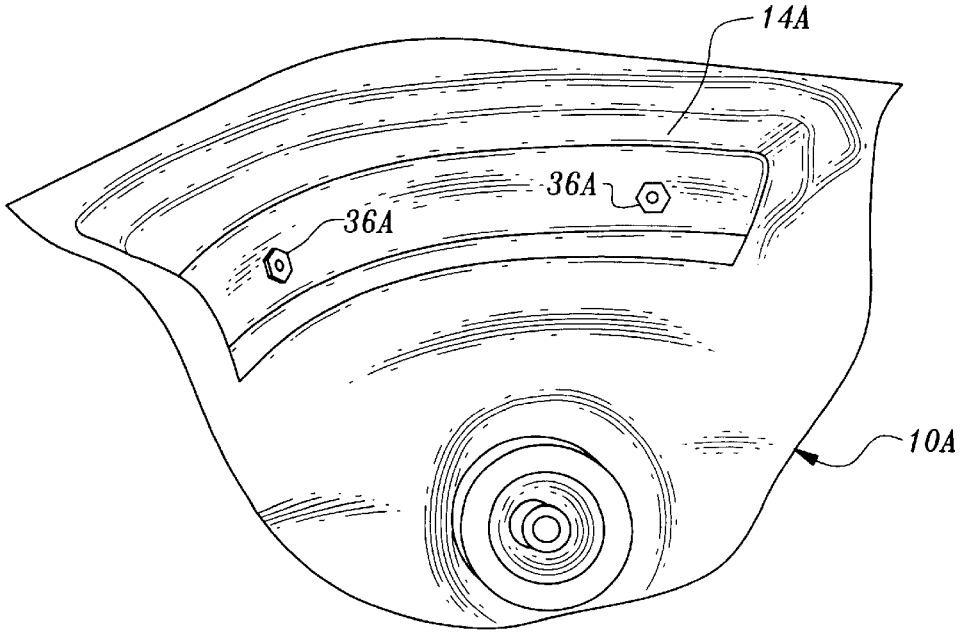
FIG. 8 is a view similar to FIG. 4, but illustrating the spa shell portion with the border pillow and insert pillow removed therefrom.

FIGS. 7 and 8 disclose another embodiment of the invention wherein a spa shell 10A forms a somewhat longer cavity 14A than that of the FIGS. 1–6 embodiment. Likewise, the shapes of the border pillow 16A and insert pillow 18A are more elongated to correspond with the shape of the cavity.

The invention claimed is:

1. In combination:

the shell of a hot tub; and pillow structure, said pillow structure comprising a border pillow having a border pillow front and a border pillow back, said border pillow defining an interior and an opening in said border pillow front communicating with said interior, connector means releasably connecting said border pillow to said shell, a portion of said connector means exposed to the interior of said border pillow, and an insert pillow releasably attached to said border pillow, said insert pillow when releasably attached to said border pillow covering said opening for preventing manual access to said connector means through said opening and for blocking said portion of said connector means from view.

2. The combination according to claim 1 wherein said insert pillow is formed of resilient material and wherein said border pillow is less resilient than said insert pillow.

3. The combination according to claim 1 wherein said connector means comprises a bushing passing through an aperture in the shell and having external threads, internal threads and a bushing head, a nut positioned externally of said shell and threadedly engaged with the external threads of said bushing, with said bushing head positioned interiorly of said shell, and a bolt threadedly engaged with the internal threads of said bushing, said bolt extending through said border pillow and having a bolt head urging said border pillow into engagement with said bushing head, said bushing head located between said shell and said border pillow.

4. The combination according to claim 1 wherein said insert pillow includes an outer peripheral surface and a detent projecting from said outer peripheral surface, said border pillow defining an indent adjacent to said opening for releasably retaining said detent to releasably attach said insert pillow to said border pillow.

5. The combination according to claim 4 wherein said detent comprises a rib and wherein said indent comprises a channel, said border pillow frictionally engaging and exerting compressive forces on said insert pillow adjacent to said channel.

6. The combination according to claim 1 wherein said border pillow and said insert pillow are constructed of plastic material.

7. The combination according to claim 6 wherein said border pillow is of integral, molded construction and formed from either polyolefin or urethane.

8. The combination according to claim 1 wherein said insert pillow is of integral, molded construction and formed from either polyolefin or urethane.

* * * * *